US006263526B1

(12) United States Patent
Tu

(10) Patent No.: US 6,263,526 B1
(45) Date of Patent: Jul. 24, 2001

(54) BABY HEAD PATTERN FORMING COT

(76) Inventor: Chin-Chuan Tu, Suite 5, Floor 6, No. 52, Bau-Shan 6th Street, Taichung City (TW)

( * ) Notice: Subject to any disclaimer, the term of this patent is extended or adjusted under 35 U.S.C. 154(b) by 0 days.

(21) Appl. No.: 09/612,452

(22) Filed: Jul. 7, 2000

(51) Int. Cl.[7] ..... A47D 9/02; A61G 7/00
(52) U.S. Cl. ..... 5/109; 5/655; 5/607; 5/603
(58) Field of Search ..... 5/109, 108, 655, 5/632, 603

(56) References Cited

U.S. PATENT DOCUMENTS 4,114,209 * 9/1978 Sandlin ..... 5/108
5,103,511 * 4/1992 Sequin ..... 5/108
5,553,337 * 9/1996 Lin ..... 5/109
5,566,413 * 10/1996 Webb et al. ..... 5/655
6,067,678 * 5/2000 Trevino ..... 5/740

* cited by examiner

*Primary Examiner*—Alexander Grosz
(74) *Attorney, Agent, or Firm*—Rosenberg, Klein & Lee

(57) ABSTRACT

A baby head pattern forming cot includes a support base having two opposite side walls each defining a pivot hole, a rotary base rotatably mounted in the support base and having two ends each provided with a pivot axle pivotally mounted in the pivot hole of the support base, a pattern forming base mounted in a receiving chamber of the rotary base and defining a body-shaped recess and a head-shaped recess, and a rotation device mounted in the support base. The rotation device includes a motor secured in the support base, a drive gear mounted on and rotated by the motor, a rotation controller secured on the motor for controlling rotation of the drive gear, a reduction gear meshing with and rotated by the drive gear, and a driven gear secured on the pivot axle of one of the two ends of the rotary base and meshing with and rotated by the reduction gear.

5 Claims, 8 Drawing Sheets

BABY HEAD PATTERN FORMING COT

BACKGROUND OF THE INVENTION

1. Field of the Invention

The present invention relates to a pattern forming cot, and more particularly to a baby head pattern forming cot.

2. Description of the Related Art

A conventional baby head pattern forming device in accordance with the prior art includes a cushion defining a recess whose shape is adapted to mate with that of the head of the baby so as to fix the baby's head, thereby achieving the purpose of forming a pattern on the baby's head.

However, the baby's head is fixed at a constant angle so that the inclined angle of the baby's head in the cushion is fixed and cannot be adjusted so that the forces are locally concentrated on a certain position of the baby's head, and cannot be distributed evenly, thereby easily deforming the baby's head during long term utilization, thereby decreasing the versatility of the baby head pattern forming device.

SUMMARY OF THE INVENTION

The present invention has arisen to mitigate and/or obviate the disadvantage of the conventional baby head pattern forming device.

In accordance with one aspect of the present invention, there is provided a baby head pattern forming cot comprising: a support base having two opposite side walls each defining a pivot hole; a rotary base rotatably mounted in the support base and defining a receiving chamber therein, the rotary base having two ends each provided with a pivot axle pivotally mounted in the pivot hole of a respective one of the two opposite side walls of the support base; a pattern forming base received in the receiving chamber of the rotary base and having a bottom with a shape mating with that of the receiving chamber, and a top defining a body-shaped recess and a head-shaped recess; and a rotation device mounted in the support base and including a motor secured in the support base, a drive gear mounted on and rotated by the motor, a rotation controller secured on the motor for controlling rotation of the drive gear, a reduction gear meshing with and rotated by the drive gear, and a driven gear secured on the pivot axle of one of the two ends of the rotary base and meshing with and rotated by the reduction gear.

In accordance with another aspect of the present invention, the baby head pattern forming cot further comprises a switch device mounted on the support base and including an angle set button and a time set button. The switch device connects with a positive/reverse rotation control circuit of the rotation controller of the motor.

In accordance with another aspect of the present invention, the switch device further includes a speed set button, and the motor is provided with a gear shift mechanism.

Further benefits and advantages of the present invention will become apparent after a careful reading of the detailed description with appropriate reference to the accompanying drawings.

DETAILED DESCRIPTION OF THE INVENTION

Figure 1:
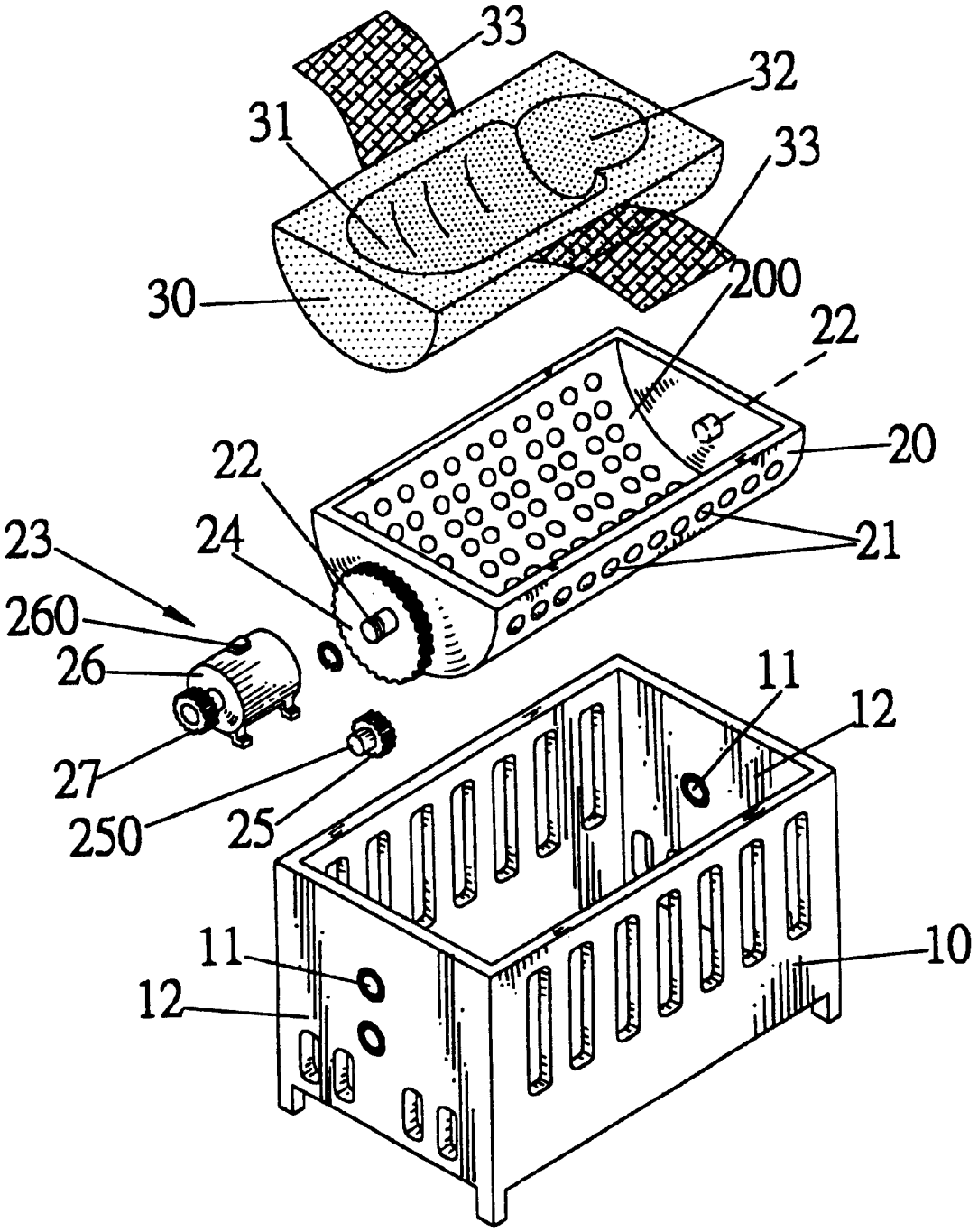
FIG. 1 is an exploded view of a baby head pattern forming cot in accordance with the present invention.
Figure 2:
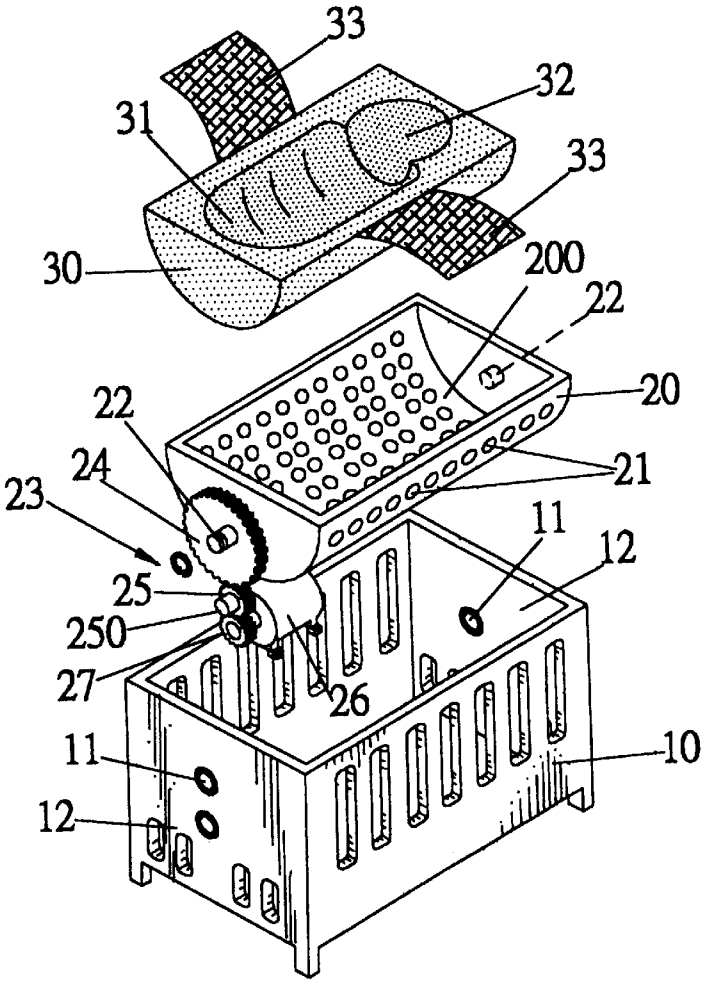
FIG. 2 is a partially exploded view of a baby head pattern forming cot in accordance with the present invention.
Figure 3:
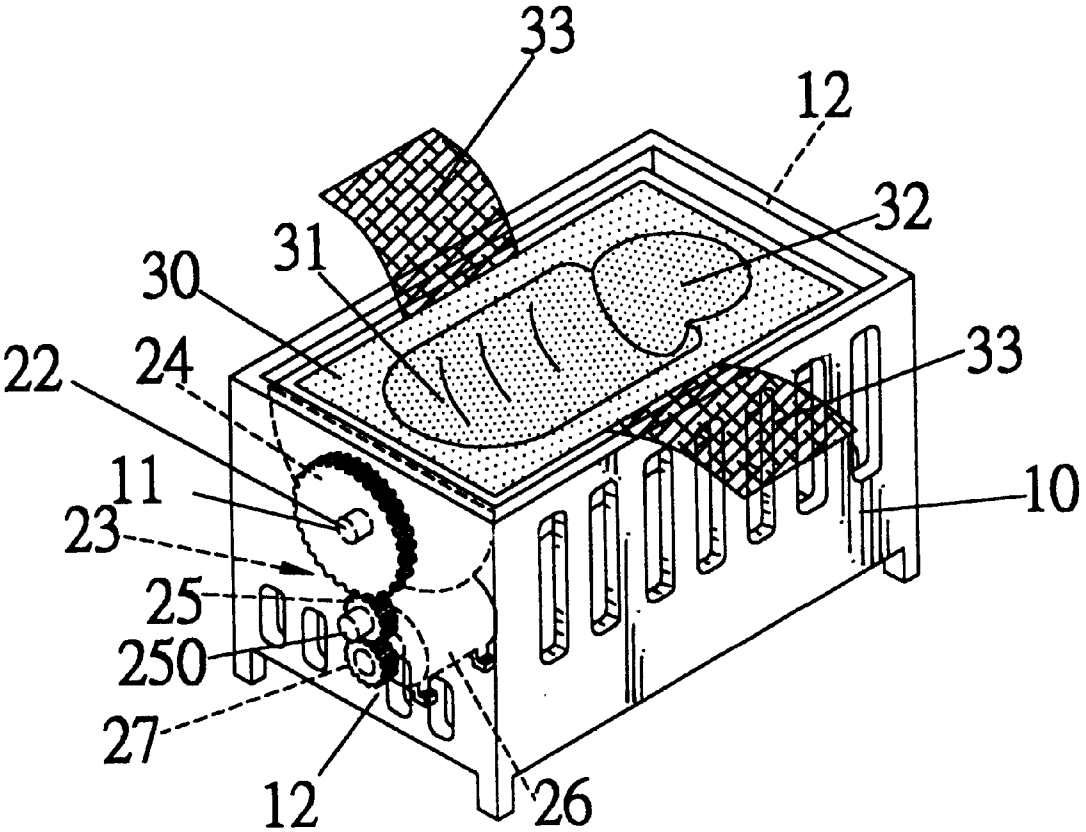
FIG. 3 is a perspective assembly view of the baby head pattern forming cot as shown in FIG. 1.

Referring to the drawings and initially to FIGS. 1–6, a baby head pattern forming cot in accordance with the present invention comprises a support base 10, a rotary base 20 rotatably mounted in the support base 10, a pattern forming base 30 made of foam material and received in the rotary base 20 to rotate therewith, and a rotation device 23 mounted in the support base 10 for rotating the rotary base 20.

The support base 10 has two opposite side walls 12 each defining a pivot hole 11.

The rotary base 20 defines a receiving chamber 200 therein and has a periphery defining a plurality of through holes 21 each connecting to the receiving chamber 200 for providing a ventilating effect. The rotary base 20 has two ends each provided with a pivot axle 22 pivotally mounted in the pivot hole 11 of a respective one of the two opposite side walls 12 of the support base 10 so that the rotary base 20 is rotatably mounted in the support base 10.

The pattern forming base 30 is received in the receiving chamber 200 of the rotary base 20 and has a bottom with a shape mating with that of the receiving chamber 200, and a top defining a body-shaped recess 31 and a head-shaped recess 32. Preferably, the pattern forming base 30 is provided with a safety strap 33 for protecting the baby.

Figure 7:
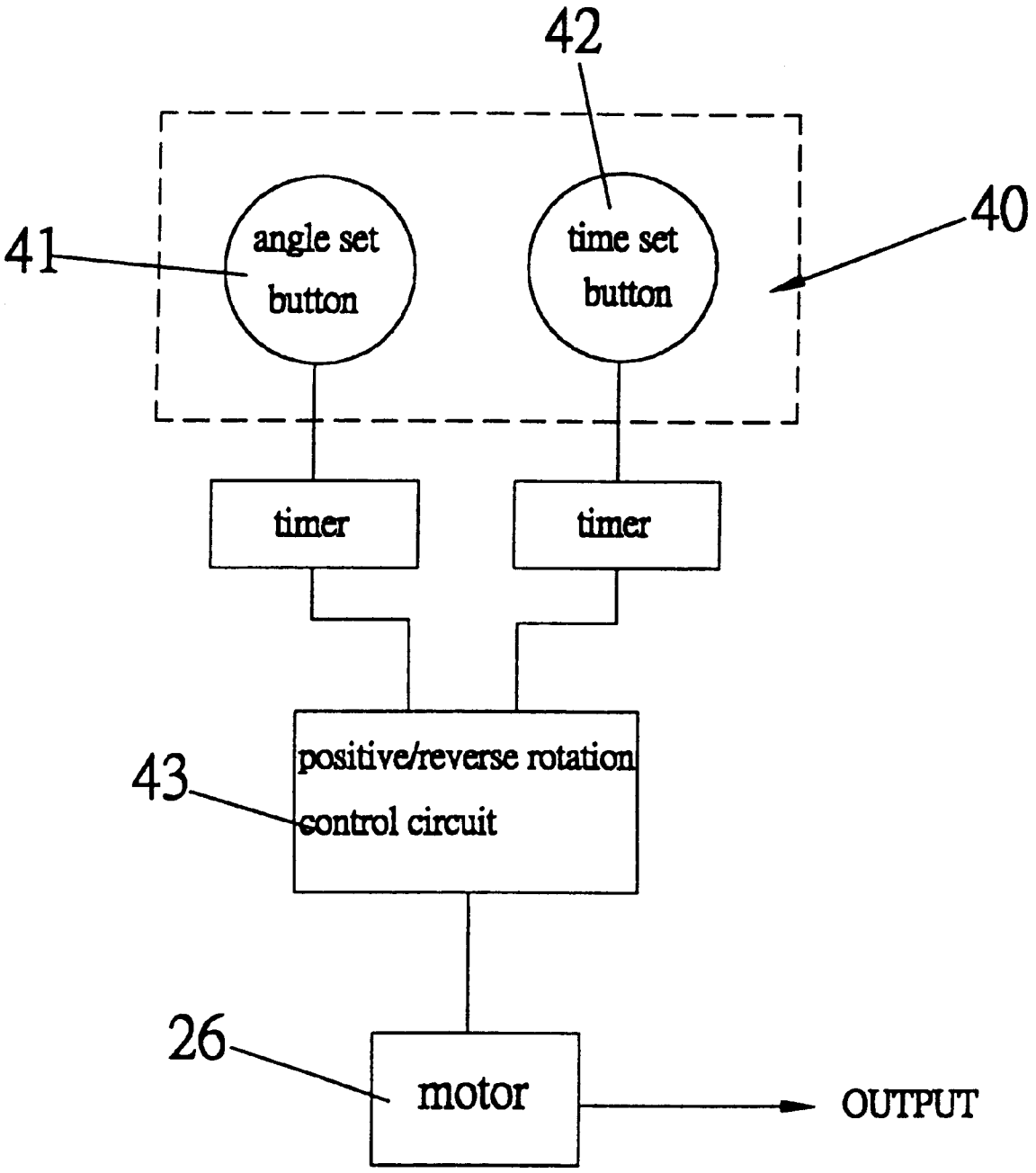
FIG. 7 is a circuit diagram of the baby head pattern forming cot in accordance with another embodiment of the present invention.

The rotation device 23 includes a motor 26 secured in the support base 10, a drive gear 27 mounted on and rotated by the motor 26, a rotation controller 260 secured on the motor 26 for controlling rotation of the drive gear 27, a reduction gear 25 meshing with and rotated by the drive gear 27, and a driven gear 24 secured on the pivot axle 22 of one of the two ends of the rotary base 20 and meshing with and rotated by the reduction gear 25. The reduction gear 25 includes a pivot shaft 250 mounted in the side wall 12 of the support base 10 so that the reduction gear 25 is rotatably mounted in the support base 10. The rotation controller 260 of the motor 26 is constructed by a positive/reverse rotation control circuit 43 as shown in FIG. 7 so as to control the time and turns of the reciprocally rotating drive gear 27 so that the pattern forming base 30 can be periodically rotated at a fixed time and at a fixed velocity by the drive gear 27, thereby properly changing the inclined angle of the baby during sleeping so as to distribute and balance the forces exerted on the head of the baby, thereby forming a perfect head pattern for the baby.

In assembly, the motor 26 is secured in the support base 10, and the drive gear 27 is mounted on and rotated by the motor 26. The pivot shaft 250 of the reduction gear 25 is rotatably mounted in the side wall 12 of the support base 10 so that the reduction gear 25 is rotatably mounted in the support base 10 and meshes with the drive gear 27. The pivot axle 22 of the rotary base 20 is then pivotally mounted in the pivot hole 11 of the side wall 12 of the support base 10 so that the rotary base 20 is rotatably mounted in the support base 10 while the driven gear 24 is secured on the pivot axle 22 of one of the two ends of the rotary base 20 for rotating the pivot axle 22 and meshes with and rotated by the reduction gear 25. The pattern forming base 30 is then received in the receiving chamber 200 of the rotary base 20. The motor 26 is controlled by the rotation controller 260 so as to rotate the drive gear 27 at a constant speed.

In such a manner, the driven gear 24 meshes with the reduction gear 25 which meshes with the drive gear 27 so that the driven gear 24 can be rotated by the drive gear 27 through the reduction gear 25 so as to rotate the pivot axle 22 which rotates the rotary base 20 which rotates the pattern forming base 30.

Figure 4:
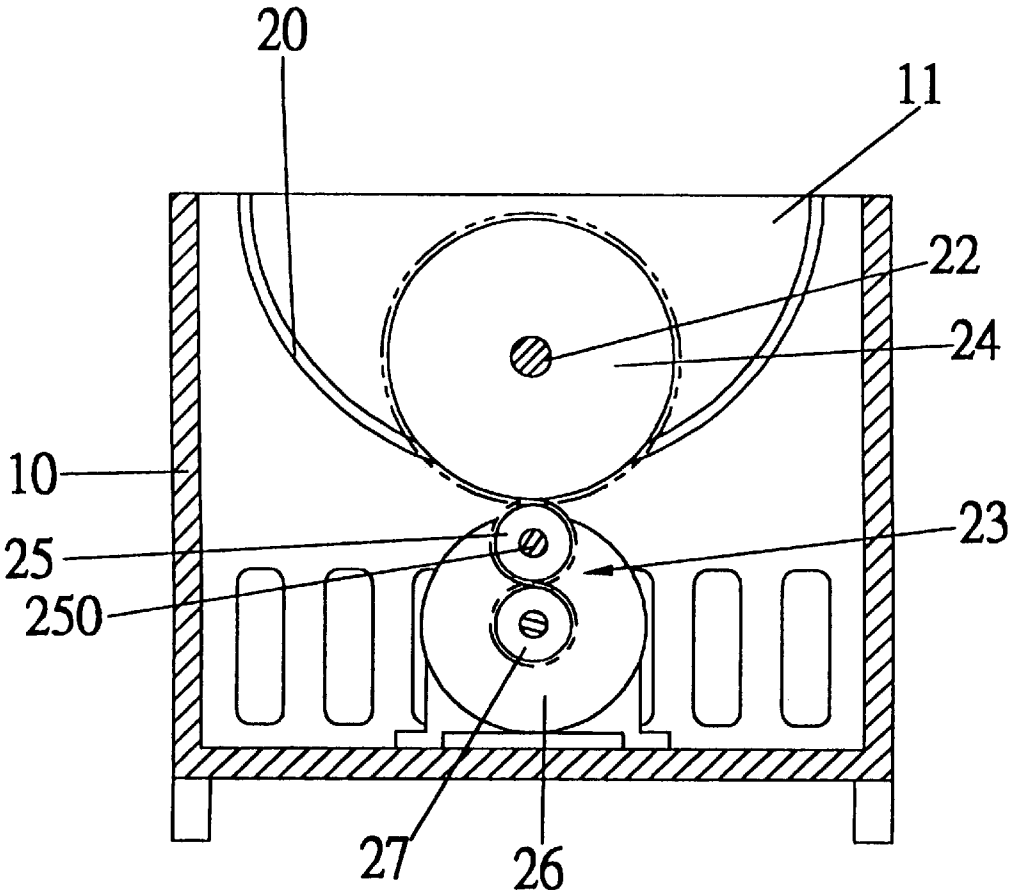
FIG. 4 is a side plan cross-sectional assembly view of the baby head pattern forming cot as shown in FIG. 1.

As shown in FIG. 4, the rotary base 20 is stationary.

Figure 5:
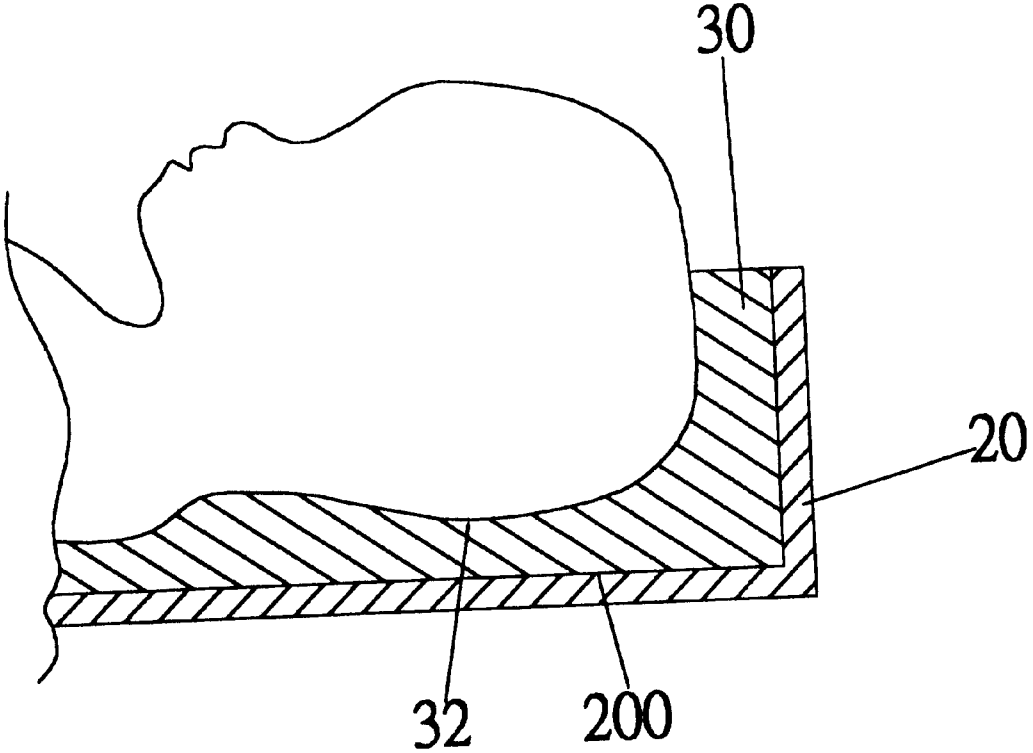
FIG. 5 is a front plan cross-sectional schematic view of the baby head pattern forming cot as shown in FIG. 1.

As shown in FIG. 5, the baby is placed in the pattern forming base 30 with its head being received in the head-shaped recess 32 of the pattern forming base 30.

Figure 6:
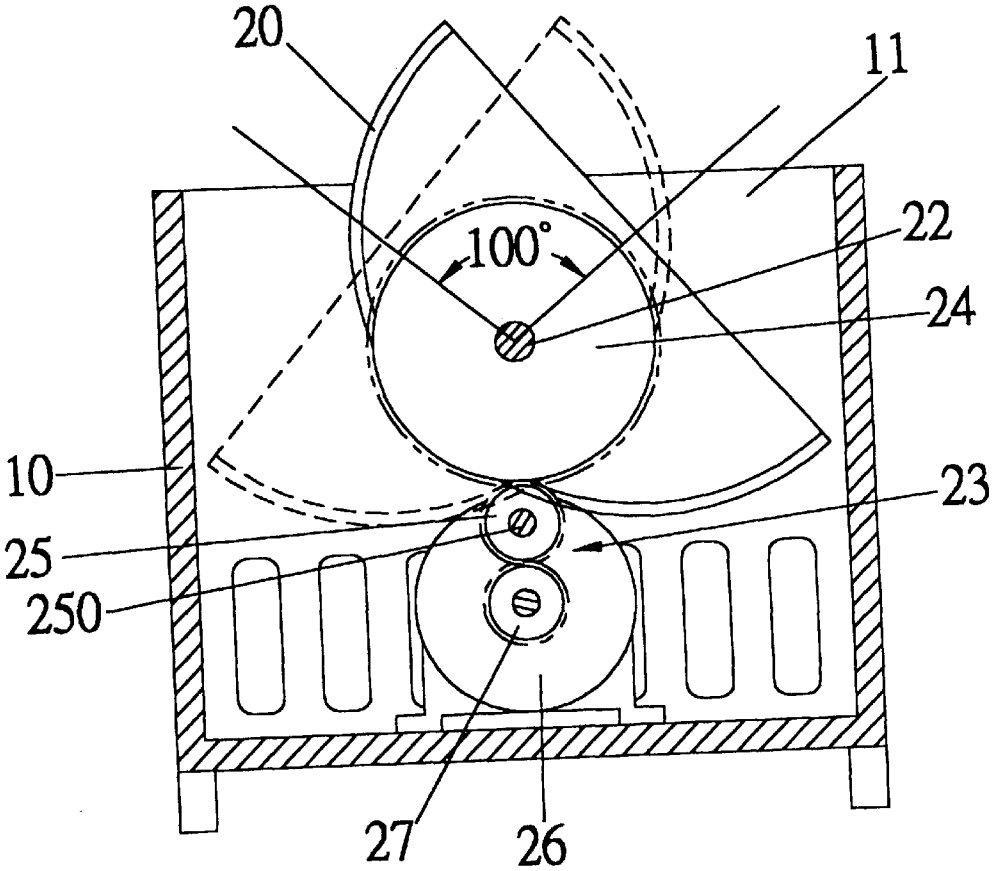
FIG. 6 is an operational view of the baby head pattern forming cot as shown in FIG. 4.

As shown in FIG. 6, the rotary base 20 can be rotated between the position as shown in solid lines and the position as shown in phantom lines.

Referring to FIG. 7, in accordance with another embodiment of the present invention, the baby head pattern forming cot further comprises a switch device 40 mounted on the support base 10 and including an angle set button 41 and a time set button 42 mounted in a control panel (not shown). The switch device 40 electrically connects to the positive/reverse rotation control circuit 43 of the rotation controller 260 of the motor 26 so as to set the angle of rotation and the time of the pattern forming base 30.

Figure 8:
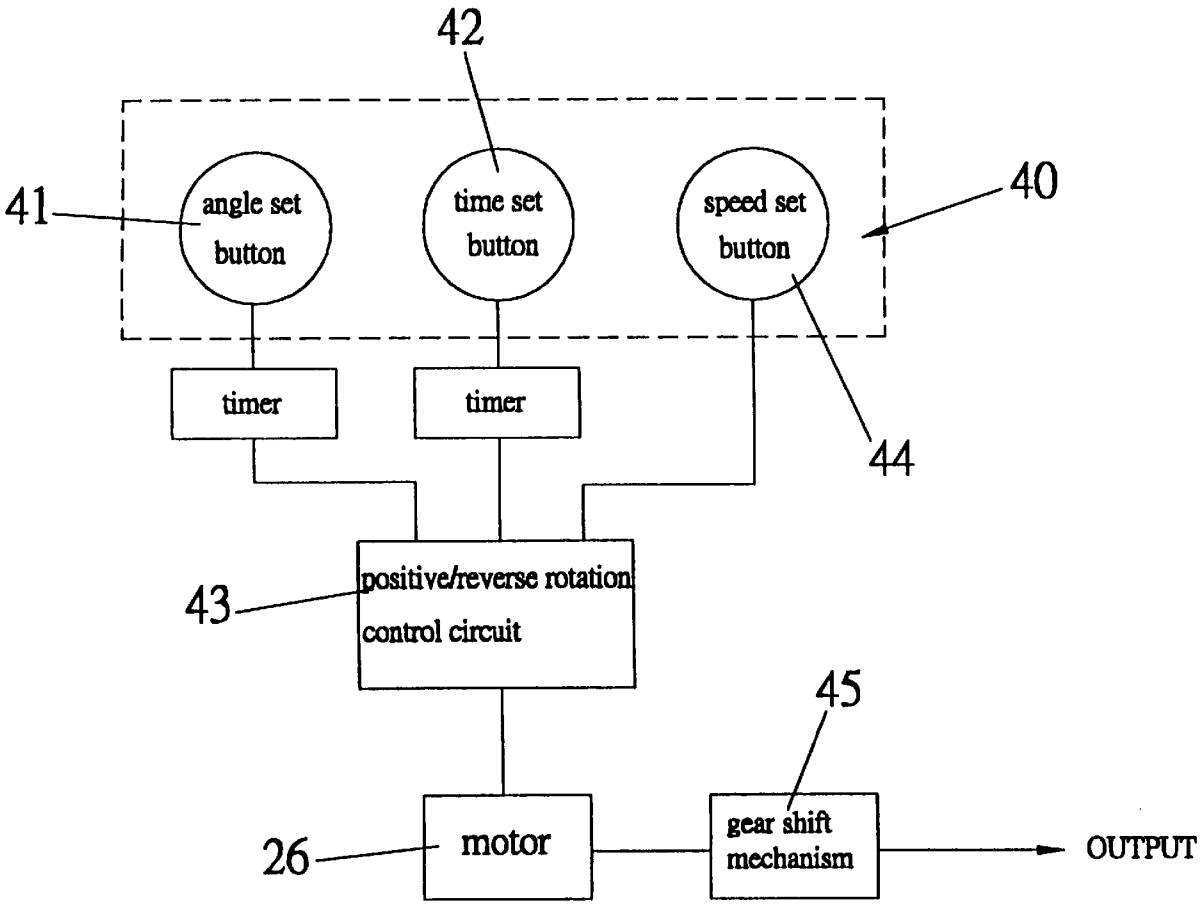
FIG. 8 is a circuit diagram of the baby head pattern forming cot in accordance with another embodiment of the present invention.

Referring to FIG. 8, in accordance with another embodiment of the present invention, the switch device 40 further includes a speed set button 44, and the motor 26 is provided with a gear shift mechanism 45 so that the speed of rotation of the motor 26 can be efficiently controlled.

Accordingly, the baby head pattern forming cot in accordance with the present invention has the following advantages.

The baby head pattern forming cot comprises a support base, a rotary base, and a pattern forming base which can be controlled to periodically reciprocally rotated at a constant speed so that the forces are evenly distributed on the head of the baby to achieve a force balance effect, thereby perfectly forming a head pattern on the baby.

In addition, the pattern forming base is rotated slowly and constantly, thereby achieving an actual head pattern forming effect so as to assure the outer appearance of the head of the baby.

Further, the periodical angle and speed of rotation of the rotary base are controlled by the rotation device automatically without needing a manual work, thereby increasing the convenience of the baby head pattern forming cot It should be clear to those skilled in the art that further embodiments may be made without departing from the scope of the present invention.

What is claimed is:

1. A baby head pattern forming cot comprising:

a support base (10) having two opposite side walls (12) each defining a pivot hole (11);

a rotary base (20) rotatably mounted in said support base (10) and defining a receiving chamber (200) therein, said rotary base (20) having two ends each provided with a pivot axle (22) pivotally mounted in said pivot hole (11) of a respective one of said two opposite side walls (12) of said support base (10);

a pattern forming base (30) received in said receiving chamber (200) of said rotary base (20) and having a bottom with a shape mating with that of said receiving chamber (200), and a top defining a body-shaped recess (31) and a head-shaped recess (32); and a rotation device (23) mounted in said support base (10) and including a motor (26) secured in said support base (10), a drive gear (27) mounted on and rotated by said motor (26), a rotation controller (260) secured on said motor (26) for controlling rotation of said drive gear (27), a reduction gear (25) meshing with and rotated by said drive gear (27), and a driven gear (24) secured on said pivot axle (22) of one of said two ends of said rotary base (20) and meshing with and rotated by said reduction gear (25).

2. The baby head pattern forming cot in accordance with claim 1, wherein said rotary base (20) has a periphery defining a plurality of through holes (21).

3. The baby head pattern forming cot in accordance with claim 1, wherein said pattern forming base (30) is provided with a safety strap (33).

4. The baby head pattern forming cot in accordance with claim 1, further comprising a switch device (40) mounted on said support base (10), said switch device (40) including an angle set button (41) and a time set button (42), and said switch device (40) connecting with a positive/reverse rotation control circuit (43) of said rotation controller (260) of said motor (26).

5. The baby head pattern forming cot in accordance with claim 4, wherein said switch device (40) further includes a speed set button (44), and said motor (26) is provided with a gear shift mechanism (45).

* * * * *